US006811828B2

(12) United States Patent
Takahashi et al.

(10) Patent No.: US 6,811,828 B2
(45) Date of Patent: Nov. 2, 2004

(54) ELECTROLESS GOLD PLATING SOLUTION AND METHOD FOR ELECTROLESS PLATING

(75) Inventors: Akio Takahashi, Shimodate (JP); Hiroshi Yamamoto, Yuki (JP); Sumiko Nakajima, Yuki (JP); Kiyoshi Hasegawa, Yuki (JP); Kanji Murakami, Mito (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/380,548

(22) PCT Filed: Sep. 18, 2003

(86) PCT No.: PCT/JP01/08086

§ 371 (c)(1),
(2), (4) Date: Mar. 17, 2001

(87) PCT Pub. No.: WO02/22909

PCT Pub. Date: Mar. 21, 2002

(65) Prior Publication Data

US 2004/0028833 A1 Feb. 12, 2004

(30) Foreign Application Priority Data

Sep. 18, 2000 (JP) ..... 2000-282108

(51) Int. Cl.[7] ..... B05D 1/18; C23C 18/44

(52) U.S. Cl. ..... 427/443.1; 427/125; 427/437; 106/1.18; 106/1.23; 106/1.26

(58) Field of Search ..... 427/443.1, 437, 427/125; 106/1.18, 1.23, 1.26

(56) References Cited

U.S. PATENT DOCUMENTS

| | | | | | |
|---|---|---|---|---|---|
| 4,919,720 | A | * | 4/1990 | Stavitsky | 106/1.26 |
| 5,116,664 | A | * | 5/1992 | Kimura et al. | 428/216 |
| 5,198,273 | A | * | 3/1993 | Ando et al. | 427/437 |
| 5,364,460 | A | * | 11/1994 | Morimoto et al. | 106/1.23 |
| 5,935,306 | A | * | 8/1999 | Reed | 106/1.23 |

FOREIGN PATENT DOCUMENTS

| | | |
|---|---|---|
| EP | 0 418 715 | 3/1991 |
| JP | 06-306623 | 11/1994 |
| JP | 09-071871 | 3/1997 |

OTHER PUBLICATIONS

International Search Report dated Dec. 11, 2001 for PCT/JP01/08086.

* cited by examiner

*Primary Examiner*—Michael Barr
(74) *Attorney, Agent, or Firm*—Antonelli, Terry, Stout & Kraus, LLP

(57) ABSTRACT

The present invention is aimed to provide an electroless gold plating solution which requires less amount of a reducing agent, retains a sufficient deposition rate for a practical use, and has an excellent stability as a plating solution; and a method for carrying out an electroless gold plating. The present invention provides an electroless gold plating solution comprising a gold salt, a phenyl compound based reducing agent and a water-soluble amine and a method for plating using the gold plating solution.

20 Claims, 1 Drawing Sheet

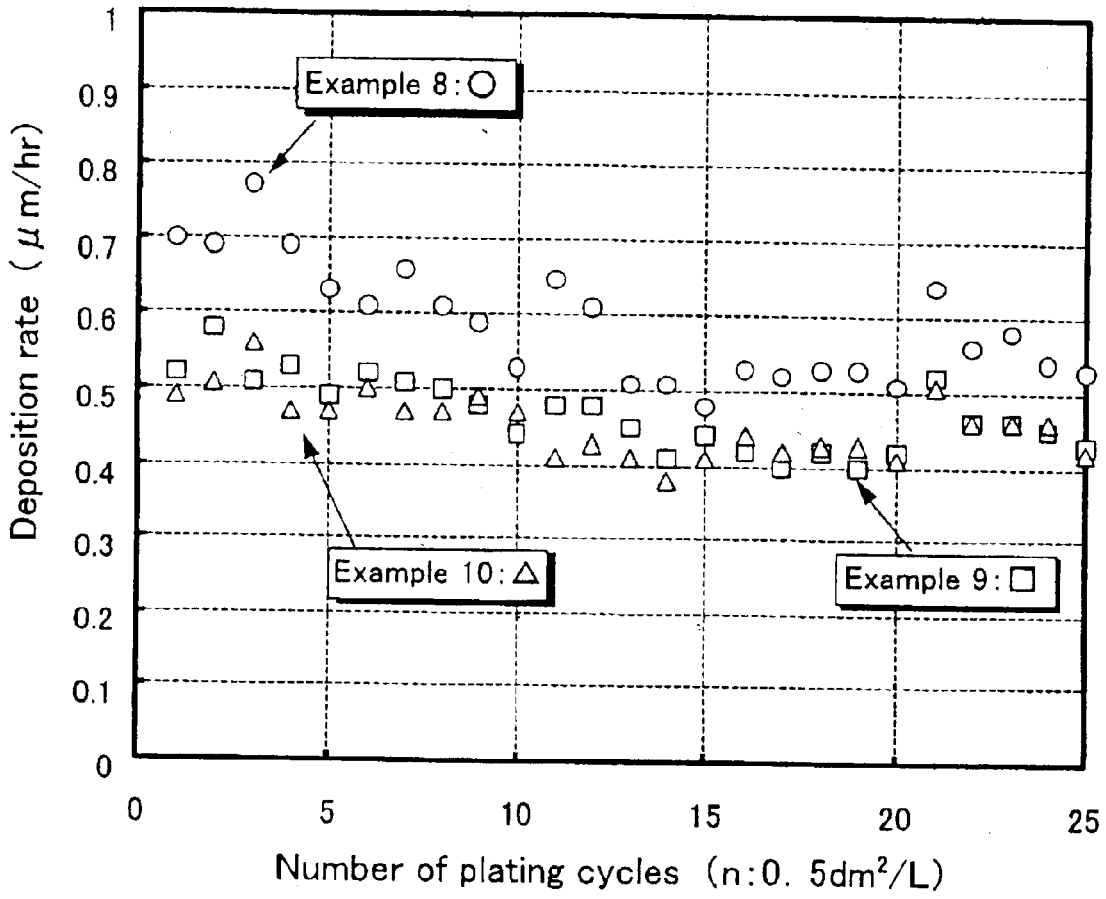
Example 8: ○
Example 10: △
Example 9: □
Deposition rate (μm/hr)
Number of plating cycles (n: 0. 5dm²/L)
0
0.1
0.2
0.3
0.4
0.5
0.6
0.7
0.8
0.9
1
0
5
10
15
20
25

ELECTROLESS GOLD PLATING SOLUTION AND METHOD FOR ELECTROLESS PLATING

FIELD OF THE INVENTION

The present invention relates to an electroless gold plating solution and a method for electroless plating.

BACKGROUND ART

There have been developed a number of electroless gold plating solutions which can be used in a neutral range at lower temperatures, so that it can be applied for a wider range of resists and electronic parts to be plated, as a substitute for a conventional electroless gold plating solution which is strongly alkaline and used at a high temperature. These plating solutions disadvantageously have a low stability and a poor deposition property. The causes for lowering stability of a plating solution are roughly classified into two types, namely, lowering of stability of the electroless gold plating itself and lowering of stability due to impurity metals mixed into the plating solution during a plating operation. For solving these problems, a number of attempts have been made to improve them.

In order to carry out an electroless gold plating in a neutral range without using a cyan compound, Japanese Prov. Patent Publication No. 191782/1989 discloses use of ascorbic acid as a reducing agent in the plating solution.

In addition, for suppressing mixing of impurity metals into the plating solution during a plating operation, or for improving stability of the plating solution, Japanese Prov. Patent Publication Nos. 350172/1992 and 145997/1994 disclose addition of a mercaptobenzothiazole based compound as a metal-shielding agent to the plating solution.

Further, Japanese Prov. Patent Publication No. 215677/1991 discloses use of a hydrazine compound (10 to 30 g/l) as a reducing agent in an electroless gold plating solution, and this plating bath can achieve a practical deposition rate in a lower concentration of the reducing agent, as compared to the above plating bath using ascorbic acid.

Furthermore, Japanese Prov. Patent Publication No. 314871/1992 discloses that the electroless gold plating solution is improved by addition of a benzotriazole based compound as a metal-shielding agent which is used for suppressing mixing of impurity metals into the plating solution during a plating operation or for improving stability of the plating solution, and that this shielding agent can be practically used in a wide use range (3 to 10 g/l).

On the other hand, Japanese Patent No. 2972209 discloses use of a thiourea compound or a phenyl compound as a reducing agent in the plating solution, and that thiourea can reduce gold in a low concentration. However, the thiourea has a problem that by-products of thiourea deteriorate stability of the plating solution and decompose the plating solution. In addition, the phenyl compound based reducing agent has a problem that it cannot reduce gold in a neutral range (pH 7 to 7.5) and hence it is inevitably used in a weakly alkaline range, so that the plating solution is decomposed during the plating. For solving the problems, Japanese Prov. Patent Publication No. 104877/1991 proposes an electroless gold plating solution containing both the thiourea compound and the phenyl compound as reducing agents, and this plating solution is improved in stability since the phenyl compound based reducing agent reduces a by-product of thiourea.

Further, Japanese Prov. Patent Publication No. 157859/1997 discloses that the above electroless gold plating bath is improved by addition of a benzotriazole based compound as a metal-shielding agent which is used for suppressing mixing of impurity metals into the plating solution during a plating operation or for improving stability of the plating solution, and that this plating bath is improved in stability, as compared to a conventional plating bath.

Ascorbic acid has a low reducing efficiency as a reducing agent. Therefore, ascorbic acid has a problem that it must be used in a sodium ascorbate concentration as high as 60 to 100 g/l for securing a practical deposition rate, i.e., 0.5 to 1.0 $\mu$m, thus lowering stability of the plating solution.

The mercaptobenzothiazole compound as a metal-shielding agent has a problem that it has a very narrow use range (0.1 to 5 ppm) and hence exhibits low operation efficiency, and deposition failure arises when it is used in a larger amount.

When a hydrazine compound is used as a reducing agent, the resultant plating bath can achieve a practical deposition rate in a low reducing agent concentration, as compared to the plating bath using ascorbic acid. However, the hydrazine compound has itself a poor stability, failing to secure a sufficient stability of the plating solution. This plating bath is improved by addition of a benzotriazole based compound as a metal-shielding agent which is used for suppressing mixing of impurity metals into the plating solution during a plating operation or for improving stability of the plating solution. However, the stability of the reducing agent itself is poor as mentioned above, and as a result, stability of the plating solution cannot be improved enough for a practical use.

The electroless gold plating solution containing both the thiourea compound and the phenyl compound as reducing agents is improved in stability by reducing by-products of thiourea with the phenyl compound based reducing agent. However, it has a problem that the by-products of thiourea cannot be completely reduced to the original reducing agent and the remaining by-products causes deposition failure or lowered stability of the plating solution, thus making it difficult to secure a sufficient stability of the plating solution.

It is an object of the present invention to provide an electroless gold plating solution and a method for electroless gold plating, which can maintain a practical deposition rate with a reduced amount of a reducing agent and achieve excellent stability of the plating solution.

DISCLOSURE OF THE INVENTION

In order to attain the above-mentioned objects, the present inventors have selected a phenyl compound based reducing agent having a high reducing efficiency, so that stability of a plating solution is less spoiled by by-products produced in reduction process, and they have made intensive and extensive studies. As a result, they have found that the presence of a water-soluble amine such as ethylene diamine, etc. is surprisingly improve deposition rate of a neutral electroless gold plating solution (pH 7.0 to 7.5) using the phenyl compound based reducing agent as a reducing agent, whereby enabling an electroless gold plating at a rate of around 1 $\mu$m/h, and provide an electroless gold plating solution having an excellent plating appearance and an excellent solution stability, without spoiling appearance and deposition property.

The present invention is characterized as follows.

(1) A gold plating solution comprising a gold salt, a phenyl compound based reducing agent and a water-soluble amine.

(2) The electroless gold plating solution according to (1), wherein the phenyl compound based reducing agent is represented by the formula (I):

(I)

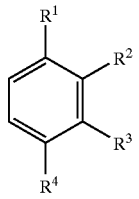

wherein $R^1$ represents a hydroxyl group or an amino group, $R^2$ to $R^4$ may be the same or different, and independently represent a hydroxyl group, an amino group a hydrogen atom or an alkyl group.

(3) The electroless gold plating solution according to (2), wherein the alkyl group for $R^2$ to $R^4$ is methyl group, ethyl group, or t-butyl group.

(4) The electroless gold plating solution according to (1) or (2), wherein the phenyl compound based reducing agent is hydroquinone, methylhydroquinone, or p-phenylenediamine.

(5) The electroless gold plating solution according to any one of (1) to (4), wherein the water-soluble amine is ethylene diamine based compound.

(6) The electroless gold plating solution according to any one of (1) to (5), which further comprises an impurity metal-shielding agent as an additive.

(7) The electroless gold plating solution according to (6), wherein the impurity metal-shielding agent is benzotriazole based compound.

(8) The electroless gold plating solution according to any one of (1) to (7), wherein a pH of the electroless gold plating solution is in the range of 5 to 10.

(9) A method for electroless plating, comprising immersing a material to be plated into a gold plating solution which comprises a gold salt, a phenyl compound based reducing agent and a water-soluble amine.

BRIEF DESCRIPTION OF THE DRAWINGS

The sole FIGURE is a graph showing a relation between the number of plating operations and a deposition rate in one example of the present invention.

BEST MODE FOR CARRYING OUT THE PRESENT INVENTION

In the electroless gold plating solution of the present invention, as the gold salt, either a cyan based gold salt or a non-cyan based gold salt can be used. As the cyan based gold salt, gold(I) cyanide-potassium or gold(II) cyanide-potassium can be used. As the non-cyan based gold salt, a chloroaurate, a gold sulfite, a gold thiosulfate, or a gold thiomalate can be used, and these can be used individually or in combination. Of these, preferred are gold sulfite and gold thiosulfate, and it is preferred that the content of the salt in the plating solution is in the range of 1 to 10 g/l, in terms of gold. When the gold content is less than 1 g/l, the gold deposition reaction may be difficult to proceed. On the other hand, when the gold content exceeds 10 g/l, stability of the plating solution may become poor, and the amount of gold consumed will increase accompanied by a loss of the plating solution, which is economically disadvantageous. Further, it is more preferred that the gold content of the plating solution is in the range of 2 to 5 g/l.

Examples of complexing agents include cyan salts, such as sodium cyanide and potassium cyanide, and non-cyan salts, such as sulfites, thiosulfates, and thiomalates. These can be used individually or in combination. Of these, preferred are sulfites and thiosulfates, and it is preferred that the content of the complexing agent in the plating solution is in the range of 1 to 200 g/l. When the complexing agent content is less than 1 g/l, the gold complexing ability may become poor to lower stability of the plating solution. On the other hand, when the complexing agent content exceeds 200 g/l, stability of the plating solution is improved, but crystallization may disadvantageously occur in the plating solution and the use of the complexing agent in such a large amount is disadvantageous from an economical point of view. Further, it is more preferred that the complexing agent content is in the range of 20 to 50 g/l.

As the reducing agent, it is preferred to use a phenyl compound based reducing agent represented by the following formula (I):

(I)

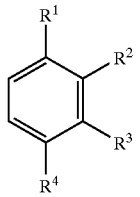

Wherein $R^1$ represents a hydroxyl group or an amino group, $R^2$ to $R^4$ may be the same or different, and independently represent a hydroxyl group, an amino group a hydrogen atom or an alkyl group.

In the above formula (I), as the alkyl group for $R^2$ to $R^4$, preferred are a linear or branched alkyl group having 1 to 6 carbon atoms, and further preferred are a linear or branched alkyl group having 1 to 4 carbon atoms, such as methyl group, ethyl group, and t-butyl group.

Specific examples of compounds of this type include phenol, o-cresol, p-cresol, o-ethylphenol, p-ethylphenol, t-butylphenol, o-aminophenol, p-aminophenol, hydroquinone, catechol, pyrogallol, methylhydroquinone, aniline, o-phenylenediamine, p-phenylenediamine, o-toluidine, p-toluidine, o-ethylaniline, p-ethylaniline, etc., and these can be used in combination of one or more kinds. Of these, preferred are p-phenylenediamine, methylhydroquinone, hydroquinone, etc., and it is preferred that the content of the compound in the plating solution is in the range of 0.5 to 50 g/l. When the content of the phenyl compound based reducing agent in the plating solution is less than 0.5 g/l, a practical deposition rate, i.e., 0.5 $\mu$m/h cannot be obtained. On the other hand, when the content of the phenyl compound based reducing agent exceeds 50 g/l, a sufficient stability of the plating solution cannot be secured. Further, it is more preferred that the content of the phenyl compound based reducing agent is in the range of 2 to 10 g/l.

As the water-soluble amine, a monoalkanolamine, a dialkanolamine, a trialkanolamine, ethylenetriamine, m-hexylamine, tetramethylenediamine, pentamethylenediamine, hexamethylenediamine, heptamethylenediamine, ethylenediamine, diethylenetriamine, triethylenetetramine, tetraethylenepentamine, pentaethylenehexamine, dimethylamine, triethanolamine, hydroxylamine sulfate, an EDTA salt, etc. can be used. Of these, preferred are ethylenediamine, diethylenetriamine, triethylenetetramine, tetraethylenepentamine, and pentaethylenehexamine, and most preferred is ethylenediamine.

It is preferred that the content of the water-soluble amine in the plating solution is in the range of 0.1 to 100 g/l. When the water-soluble amine content is less than 0.1 g/l, the effect aimed at by addition of the amine cannot be sufficiently exhibited. On the other hand, when the content of the water-soluble amine exceeds 100 g/l, stability of the plating solution may be lowered disadvantageously. Further, it is more preferred that the water-soluble amine content is in the range of 2 to 10 g/l. One or more kinds of the above water-soluble amines may be added, and by addition of the water-soluble amine to the electroless gold plating solution, the deposition rate of the electroless gold plating solution can be increased, the appearance of the gold-plated surface is improved as well as the deposition property, and in addition, solution stability of the plating solution is significantly improved.

In the electroless gold plating solution of the present invention, in order to maintain a desired deposition rate and pH, etc., constant, a pH buffer can be added. Examples of compounds which are conventionally preferably used as the pH buffer include phosphates, acetates, carbonates, borates, citrates, and sulfates, and one or more kinds thereof can be used. Of these, preferred are borates and sulfates, and it is preferred that the amount thereof to be added is in the range of 1 to 100 g/l. When the amount of the pH buffer added is less than 1 g/l, the effect of buffering pH is not exhibited, and condition of the plating bath may be changed. On the other hand, when the amount of the pH buffer added exceeds 100 g/l, re-crystallization may occur in the plating solution, which is not preferred. Further, it is more preferred that the amount of the pH buffer added is in the range of 20 to 50 g/l.

Further, impurities, such as pieces of rust of a plating apparatus, are mixed into the plating solution during a plating operation, or an underlying metal is mixed into the plating solution due to deposition failure of the material to be plated, so that impurity ions of copper, nickel, or iron may be mixed into the plating solution. In such a case, an inappropriate reaction is likely to proceed in the plating solution, leading to decomposition of the plating solution. For suppressing such an inappropriate reaction in the plating solution, an impurity metal-shielding agent can be added to the plating solution.

As the impurity metal-shielding agent, generally, a benzotriazole based compound can be used, and examples include benzotriazole-sodium, benzotriazole-potassium, tetrahydrobenzotriazole, methylbenzotriazole, nitrobenzotriazole, etc. It is preferred that the amount of the impurity metal-shielding agent added is in the range of 0.5 to 100 g/l. When the amount of the impurity metal-shielding agent added is less than 0.5 g/l, the effect of shielding impurities may be poor and a sufficient stability of the plating solution cannot be achieved. On the other hand, when the amount of the impurity metal-shielding agent added exceeds 100 g/l, re-crystallization may disadvantageously occur in the plating solution. Further, in consideration of optimizing cost and effect, it is more preferred that the amount of the impurity metal-shielding agent added is in the range of 2 to 10 g/l.

It is preferred that the electroless gold plating solution has a pH in the range of 5 to 10. When the pH of the plating solution is less than 5, there is a danger that a sulfite or a thiosulfate as an Au complexing agent contained in the plating solution is decomposed to generate a toxic sulfurous acid gas. On the other hand, when the pH of the plating solution to be used exceeds 10, stability of the plating solution may disadvantageously be lowered. Further, the electroless gold plating solution is more preferably used at a pH in the range of 6 to 8, most preferably in the range of 7 to 8.

EXAMPLES

Preparation of Samples

A calendered copper sheet having a size of 3 cm×3 cm×0.3 mm was used as a sample for plating test, and it was treated with an acid degreaser, Z-200 (trade name; manufactured by WORLD METAL CO., LTD.), at 45° C. for 3 minutes to remove rust and organic substances from the surface thereof. Then, the resultant sheet was washed with warm water (pure water at 45° C.) for one minute to remove an excess surfactant, and then washed with water for one minute. Further, the sheet was subjected to soft etching treatment, in which it was immersed in an ammonium persulfate solution (120 g/l) at room temperature for 3 minutes to render the form of the surface of the sheet uniform. Subsequently, the sheet was washed with water for one minute. Further, the resultant sheet was immersed in sulfuric acid (10%) at room temperature for one minute to remove copper oxide from the surface of the sheet, and then, washed with water for one minute. Then, the sheet was immersed in a substitution palladium plating solution, SA-100 (trade name; manufactured by Hitachi Chemical Co., Ltd.), at room temperature for 5 minutes, and then washed with water for one minute.

Subsequently, the resultant sheet was immersed in an electroless Ni-P plating solution, NIPS-100 (trade name; manufactured by Hitachi Chemical Co:, Ltd.), at 85° C. for 25 minutes so that the nickel-phosphorus deposit had a thickness of about 5 μm, and the sheet was washed with water for one minute. Then, the resultant sheet was immersed in a substitution gold plating solution, HGS-500 (trade name; manufactured by Hitachi Chemical Co., Ltd.), at 85° C. for 10 minutes so that the gold deposit had a thickness of about 0.1 μm, and washed with water for one minute. The obtained sheet was evaluated by the following electroless gold plating. For evaluation of an electroless gold plating solution, a plating bath made of a polypropylene resin was used.

Method of Plating Bath Stability Test: 75° C.

In the plating bath stability test, a one-liter beaker made of a polypropylene (PP) resin was used as a plating bath. Before starting the test, the plating bath was washed with aqua regia (nitric acid:hydrochloric acid=1:3, diluted with pure water so that the concentration became 50%) at room temperature for 6 hours or longer to remove impurities adhered to the inside of the bath, and then, it was used in the test.

The plating bath stability test was carried out as follows. Using the above-prepared plating bath for test, a plating solution was treated at a plating load of 0.5 $dm^2/l$ for one hour (70° C.), and then the resultant plating solution was maintained at 75° C., which corresponds to a temperature slightly higher than the temperature at which it is generally used. A plating bath in which no defective deposition occurred in the bath for 10 hours or longer was evaluated as ○ (Excellent); a plating bath in which no defective deposition occurred in the bath for 5 hours or longer but less than 10 hours was evaluated as Δ (Moderate); and a plating bath in which defective deposition occurred in the bath within 5 hours was evaluated as X (Poor).

Method of Plating Bath Stability Accelerated Test: 90° C.

In the plating bath stability accelerated test, a one-liter beaker made of a polypropylene (PP) resin was used as a plating bath. Before starting the test, the plating bath was washed with aqua regia (nitric acid:hydrochloric acid=1:3, diluted with pure water so that the concentration became 50%) at room temperature for 6 hours or longer to remove impurities adhered to the inside of the bath, and then, it was used in the test.

The plating bath stability accelerated test was carried out as follows. Using the above-prepared plating bath for test, a plating solution was treated at a plating load of 0.5 $dm^2/l$ for one hour (70° C.), and then the temperature of the resultant plating solution was elevated to 90° C. so that the plating solution was under severe conditions, and a period of time until defective deposition of gold occurred in the bath was measured and used as an index for evaluation of stability of the plating solution. A plating bath in which no defective deposition occurred in the bath for 10 hours or longer was evaluated as ○ (Excellent); a plating bath in which no defective deposition occurred in the bath for 5 hours or longer but less than 10 hours was evaluated as Δ (Moderate); and a plating bath in which defective deposition occurred in the bath within 5 hours was evaluated as X (Poor).

Examples 1 to 7

The results of Examples are shown in Table 1. In Examples 1 to 3, electroless gold plating was individually conducted in ethylenediamine concentrations of 1 g/l, 2 g/l, and 5 g/l. As can be seen in Table 1, the deposition rate was gradually improved, i.e., 0.36 μm/hr, 0.51 μm/hr, and 0.61 μm/hr even under conditions such that the concentration of hydroquinone as a reducing agent was low. In addition, each deposit had an excellent appearance with uniform lemon yellow luster and suffered neither discoloration nor deposition failure. Further, each plating bath was evaluated as excellent in the plating bath stability test (75° C.), and also in the plating bath stability accelerated test (90° C.), being stable for 10 hours or longer, without causing a defective deposition in each plating bath. Furthermore, each plating solution had such an excellent storage stability that no defective deposition occurred in the plating bath after being stored at room temperature for 30 days or longer.

In Examples 4, 5, and 6, electroless gold plating was individually conducted by changing concentration of hydroquinone as a reducing agent to 0.5 g/l, 2 g/l, and 3 g/l. The deposition rate was gradually improved, i.e., 0.38 μm/hr, 0.83 μm/hr, and 1.01 μm/hr. This result showed that a practical deposition rate could be achieved even under conditions such that the plating solution had a low reducing agent concentration (2 to 3 g/l), and in around a neutral range at pH of 7.5. In addition, each deposit had an excellent appearance with uniform lemon yellow luster and suffered neither discoloration nor deposition. Further, each plating bath was evaluated as excellent in the plating bath stability test (75° C.), and also in the plating bath stability accelerated test (90° C.), being stable for 10 hours or longer, without causing a defective deposition in each plating bath. Furthermore, each plating solution had such excellent storage stability that no defective deposition occurred in the plating bath after being stored at room temperature for 30 days or longer.

In Example 7, the pH of the plating solution was changed from 7.5 to 7.1. The deposition rate in Example 7 was as low as 0.59 μm/hr, as compared to that in Example 5, but it was satisfactory for a practical use. Further, each deposit had an excellent appearance with uniform lemon yellow luster and suffered neither discoloration nor deposition. Further, each plating bath was evaluated as excellent in the plating bath stability test (75° C.), and also in the plating bath stability accelerated test (90° C.), being stable for 10 hours or longer, without causing a defective deposition in each plating bath. Furthermore, each plating solution had such excellent storage stability that no defective deposition occurred in the plating bath after being stored at room temperature for 30 days or longer.

TABLE 1

| Bath composition: g/L | | Example1 | Example2 | Example3 | Example4 | Example5 | Example6 | Example7 |
|---|---|---|---|---|---|---|---|---|
| Au ion source | Au sodium sulfite | 2.5 g/L in terms of Au | | | | | | |
| Complexing agent | Sodium sulfite (anhydrous) | 32 | 32 | 32 | 32 | 32 | 32 | 32 |
| | Sodium thiosulfate pentahydrate | 26 | 26 | 26 | 26 | 26 | 26 | 26 |
| pH buffer | Dipotassium tetraborate tetrahydrate | 25 | 25 | 25 | 25 | 25 | 25 | 25 |
| Metal-shielding agent | Benzotriazole | 2.5 | 2.5 | 2.5 | 2.5 | 2.5 | 2.5 | 2.5 |
| Water-soluble amine | Ethylene diamine | 1 | 2 | 5 | 5 | 5 | 5 | 5 |
| Reducing agent | Thiourea | 0 | 0 | 0 | 0 | 0 | 0 | 0 |
| | Hydroquinone | 1 | 1 | 1 | 0.5 | 2 | 3 | 2 |
| pH | | 7.5 | 7.5 | 7.5 | 7.5 | 7.5 | 7.5 | 7.1 |
| Plating load($dm^2$/L) | | 0.5 | 0.5 | 0.5 | 0.5 | 0.5 | 0.5 | 0.5 |
| Bath temperature | | 70 | 70 | 70 | 70 | 70 | 70 | 70 |
| Deposition rate(μm/hr) | | 0.36 | 0.51 | 0.61 | 0.38 | 0.83 | 1.01 | 0.59 |
| Coat appearance | | Lemon yellow | Lemon yellow | Lemon yellow | Lemon yellow | Lemon yellow | Lemon yellow | Lemon yellow |
| Deposition failure | | None | None | None | None | None | None | None |
| Bath stability test(75° C.) | | ○ (10 hr) | ○ (10 hr) | ○ (10 hr) | ○ (10 hr) | ○ (10 hr) | ○ (10 hr) | ○ (10 hr) |
| Bath stability accelerated test(heated at 90° C. after loading: hr) | | ○ (10 hr) | ○ (10 hr) | ○ (10 hr) | ○ (10 hr) | ○ (10 hr) | ○ (10 hr) | ○ (10 hr) |
| Storage stability(at room temperature: day) | | 30 days or longer | 30 days or longer | 30 days or longer | 30 days or longer | 30 days or longer | 30 days or longer | 30 days or longer |

Examples 8 to 10

Using plating solutions having the compositions shown in Table 2, electroless gold plating was continuously carried out to evaluate the practical performance in continuous use of each electroless gold plating solution. The test was carried out continuously for 5 days. The changes in the deposition rates are shown in the sole FIGURE. The plating treatments were carried out in a practical manner, for successive 5 days, repeating 25 cycles, at 70° C. As a result, in each of Examples 8, 9, and 10, electroless gold plating could be continuously used at a deposition rate of 0.4 to 0.7 μm/hr. In addition, in each of Examples 8, 9, and 10, the deposit obtained in each of the 25 cycles had an excellent appearance with uniform lemon yellow luster and suffered neither discoloration nor deposition failure.

TABLE 2

| Bath composition:g/L | | Example 8 | Example 9 | Example 10 |
|---|---|---|---|---|
| Au ion source | Au sodium sulfite | 2.5 g/L in terms of Au | | |
| Complexing agent | Sodium sulfite (anhydrous) | 32 | 32 | 32 |
| | Sodium thiosulfite pentahydrate | 26 | 26 | 26 |
| pH buffer | Dipotassium tetraborate tetrahydrate | 25 | 25 | 25 |
| Metal-shielding agent | Benzotriazole | 2.5 | 2.5 | 2.5 |
| Water-soluble amine | Ethylene diamine | 3 | 4 | 5 |
| Reducing agent | Thiourea | — | — | — |
| | Hydroquinone | 2 | 1 | 1 |
| pH | | 7.5 | 7.5 | 7.5 |
| Plating load ($dm^2$/L) | | 0.5 | 0.5 | 0.5 |
| Bath temperature | | 70 | 70 | 70 |
| Deposition rate (μm/hr) | | 0.7 | 0.52 | 0.49 |
| Bath stability test (75° C.) | | ○ (10 hr) | ○ (10 hr) | ○ (10 hr) |
| Days of continuous use (day) | | 5 days or longer | 5 days or longer | 5 days or longer |
| Hours of continuous heating (hr/70° C.) | | 50 hrs or longer | 50 hrs or longer | 50 hrs or longer |

Further, with respect to stability of the plating solution, as shown in Table 3, it has been confirmed that the plating baths in Examples 8, 9, and 10 individually exhibited such excellent stability that no defective deposition was observed in each plating bath after the plating bath was continuously used for 8 hours or longer per day for 5 days (52 hours in total) at 70° C. which is a practical temperature.

Comparative Examples

In Comparative Examples 1 and 2, hydroquinone was used as a reducing agent in a conventional plating bath, and the test results are shown in Table 4. In Comparative Example 1 in which the hydroquinone concentration was 1.1 g/l, the deposit had an excellent appearance without suffering deposition failure, however, the deposition rate was as low as 0.13 μm/hr, and a deposition rate determined by subtracting the deposition of about 0.1 μm formed by substitution gold plating from the above deposition rate was as low as 0.03 μm/hr, indicating that almost no deposition by reduction proceeded. For this reason, it is considered that this plating solution is difficult to be brought into practical use, and hence, the plating bath stability test, the plating bath stability accelerated test, and the test for storage stability were not conducted.

On the other hand, in Comparative Example 2, for improving the deposition rate, plating was carried out under conditions such that the reducing agent concentration was about three times as high as that in Comparative Example 1. Like in Comparative Example 1, the deposit had an excellent appearance without suffering deposition failure, but the deposition rate was as low as 0.3 μm/hr. Further, in the plating bath stability test, defective deposition occurred in the bath in 5 hours at 75° C. In addition, in the plating bath stability accelerated test, it has been found that defective deposition occurred in the bath in 2 hours. Further, it has been found that, in the test for storage stability, defective deposition occurred in the bath after the plating solution was allowed to stand at room temperature for one day, making it difficult to use the plating solution any more.

Further, in Comparative Example 3, for improving the deposition rate, plating was carried out under conditions such that the reducing agent concentration was five times as high as that in Comparative Example 1 and the pH of the plating solution was 9.0. As a result, the plating solution

TABLE 3

| | | Example8 | | | Example9 | | | Example10 | | |
|---|---|---|---|---|---|---|---|---|---|---|
| Cycles | Days of plating | Deposition rate μm/hr | Heating time hr/day·70° C. | Defective deposition in bath | Deposition rate μm/hr | Heating time hr/day·70° C. | Defective deposition in bath | Deposition rate μm/hr | Heating time hr/day·70° C. | Defective deposition in bath |
| 1 | 1st day | 0.7 | 8 hr | ○ (None) | 0.52 | 8 hr | ○ (None) | 0.49 | 8 hr | ○ (None) |
| 2 | | 0.69 | | | 0.58 | | | 0.51 | | |
| 3 | | 0.77 | | | 0.51 | | | 0.56 | | |
| 4 | 2nd day | 0.69 | 12 hr | ○ (None) | 0.53 | 12 hr | ○ (None) | 0.47 | 12 hr | ○ (None) |
| 5 | | 0.63 | | | 0.49 | | | 0.47 | | |
| 6 | | 0.61 | | | 0.52 | | | 0.5 | | |
| 7 | | 0.66 | | | 0.51 | | | 0.47 | | |
| 8 | | 0.61 | | | 0.5 | | | 0.47 | | |
| 9 | | 0.59 | | | 0.48 | | | 0.49 | | |
| 10 | 3rd day | 0.53 | 12 hr | ○ (None) | 0.44 | 12 hr | ○ (None) | 0.47 | 12 hr | ○ (None) |
| 11 | | 0.65 | | | 0.48 | | | 0.41 | | |
| 12 | | 0.61 | | | 0.48 | | | 0.43 | | |
| 13 | | 0.51 | | | 0.45 | | | 0.41 | | |
| 14 | | 0.51 | | | 0.41 | | | 0.38 | | |
| 15 | | 0.48 | | | 0.44 | | | 0.41 | | |
| 16 | | 0.53 | | | 0.42 | | | 0.44 | | |
| 17 | 4th day | 0.52 | 10 hr | ○ (None) | 0.4 | 10 hr | ○ (None) | 0.42 | 10 hr | ○ (None) |
| 18 | | 0.53 | | | 0.42 | | | 0.43 | | |
| 19 | | 0.53 | | | 0.4 | | | 0.43 | | |
| 20 | | 0.51 | | | 0.42 | | | 0.41 | | |
| 21 | 5th day | 0.64 | 10 hr | ○ (None) | 0.52 | 10 hr | ○ (None) | 0.51 | 10 hr | ○ (None) |
| 22 | | 0.56 | (Total hours | | 0.46 | (Total hours | | 0.46 | (Total hours | |
| 23 | | 0.58 | for heating | | 0.46 | for heating | | 0.46 | for heating | |
| 24 | | 0.54 | 52 hr) | | 0.45 | 52 hr) | | 0.46 | 52 hr) | |
| 25 | | 0.53 | | | 0.43 | | | 0.42 | | |

showed a practical deposition rate of 1.1 μm/hr. No deposition failure was observed, but the deposit had a bad appearance, which was reddish brown. In addition, it was found that the plating solution had very poor stability, and defective deposition occurred in the bath during plating (70° C.), making it difficult to use the plating solution any more. For this reason, it is considered that this plating solution is difficult to be brought into practical use, and hence, the plating bath stability accelerated test and the test for storage stability were not carried out.

In addition, in Comparative Example 4, an electroless gold plating solution using a conventional plating bath containing two types of components, i.e., thiourea as a reducing agent and hydroquinone as a reducing promoter was evaluated. As a result, in the plating bath stability test at 70° C., which is a practical temperature, it was evaluated as moderate, having defective deposition in the bath in about 8 hours. In addition, it has been found that the plating solution had a deposition rate within a practical range of 0.75 μm/hr. Further, it has been found that the deposit had a good appearance, but deposition failure was partially observed. Furthermore, it has been found that, like in Comparative Example 2, in the plating bath stability accelerated test, defective deposition occurred in the bath in about two hours to decompose the plating solution, making it difficult to use the plating solution any more. In addition, it has been found that, in the test for storage stability, defective deposition occurred in the bath after the plating solution was allowed to stand at room temperature for 5 days, making it difficult to use the plating solution any more.

TABLE 4

| Bath composition: g/L | | Comparative Example1 | Comparative Example2 | Comparative Example3 | Comparative Example4 |
|---|---|---|---|---|---|
| Au ion source | Au sodium sulfite | | 2.5 g/L in terms of Au | | |
| Complexing agent | Sodium sulfite (anhydrous) | 32 | 32 | 32 | 32 |
| | Sodium thiosulfite pentahydrate | 26 | 26 | 26 | 26 |
| pH buffer | Dipotassium tetraborate tetrahydrate | 25 | 25 | 25 | 25 |
| Metal-shielding agent | Benzotriazole | 2.5 | 2.5 | 2.5 | 2.5 |
| Water-soluble amine | Ethylene diamine | 0 | 0 | 0 | 0 |
| Reducing agent | Thiourea | 0 | 0 | 0 | 1.1 |
| | Hydroquinone | 1.1 | 3 | 5 | 1.3 |
| pH | | 7.5 | 7.5 | 9 | 7.5 |
| Plating load ($dm^2$/L) | | 0.5 | 0.5 | 0.5 | 0.5 |
| Bath temperature | | 70 | 70 | 70 | 70 |
| Deposition rate (μm/hr) | | 0.13 | 0.3 | 1.1 | 0.75 |
| Coat appearance | | Lemon yellow | Lemon yellow | Reddish brown | Lemon yellow |
| Deposition failure | | None | None | None | Partially observed |
| Bath stability test (75° C.) | | Not conducted | Δ (5 hr) | Not conducted | Δ (8 hr) |
| Bath stability accelerated test(heated at 90° C. after loading: hr) | | Not conducted : | x (2 hr) | Not conducted | X (2hr) |
| Storage stability (at room temperature: day) | | Not conducted | 1 day | Not conducted | 5 day |

From the above results, it is found that the electroless gold plating solution of the present invention can achieve a practical deposition rate in a low reducing agent concentration, as compared to a conventional plating bath using hydroquinone, and it can achieve both excellent stability and high deposition rate.

Further, it is found that the electroless gold plating solution of the present invention can be continuously used while achieving a practical plating rate (0.5 to 1.0 μm/hr) under conditions of pH in a proximity of neutral range (6 to 8) and at a low temperature (60 to 70° C.), and that the electroless gold plating solution has extremely excellent stability, as compared to a conventional electroless gold plating solution, and hence it is possible to considerably reduce a loss in operation, such as a labor of changing contents of the plating bath.

Thereby, it is possible to realize electroless gold plating in a neutral range, which had not been brought into practical use for a reason that the plating solution has a poor stability and cannot be applied to mass production, and therefore, the electroless gold plating can be applicable for a wider range of materials and electronic parts.

INDUSTRIAL APPLICABILITY

As described above, according to the present invention, there can be provided an electroless gold plating solution and a method for an electroless gold plating, which can maintain a practical deposition rate using a reduced amount of a reducing agent and achieve excellent stability of the plating solution.

What is claimed is:

1. A gold plating solution comprising a gold salt, a phenyl compound based reducing agent, and a water-soluble amine selected from the group consisting of ethylenediamine, diethylenetriamine, triethylenetetramine, tetraethylenepentamine and pentaethylenehexamine.

2. The electroless gold plating solution according to claim 1, wherein the phenyl compound based reducing agent is represented by the formula (I):

(I)

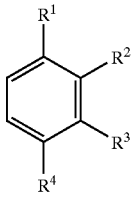

wherein $R^1$ represents a hydroxyl group or an amino group, $R^2$ to $R^4$ may be the same or different, and independently represent a hydroxyl group, an amino group, a hydrogen atom or an alkyl group.

3. The electroless gold plating solution according to claim 2, wherein the alkyl group for $R^2$ to $R^4$ is methyl group, ethyl group, or t-butyl group.

4. The electroless gold plating solution according to claim 1 or 2, wherein the phenyl compound based reducing agent is hydroquinone, methylhydroquinone, or p-phenylenediamine.

5. The electroless gold plating solution according to any one of claims 1 to 3, which further comprises an impurity metal-shielding agent as an additive.

6. The electroless gold plating solution according to claim 5 wherein the impurity metal-shielding agent is benzotriazole based compound.

7. The electroless gold plating solution according to any one of claims 1 to 3, wherein a pH of the electroless gold plating solution is in the range of 5 to 10.

8. The electroless gold plating solution according to claim 4, which further comprises an impurity metal-shielding agent as an additive.

9. The electroless gold plating solution according to claim 4, wherein a pH of the electroless gold plating solution is in the range of 5 to 10.

10. The electroless gold plating solution according to claim 5, wherein a pH of the electroless gold plating solution is in the range of 5 to 10.

11. The electroless gold plating solution according to claim 6, wherein a pH of the electroless gold plating solution is in the range of 5 to 10.

12. The electroless gold plating solution according to claim 4, wherein the phenyl compound based reducing agent is hydroquinone or methylhydroquinone.

13. The electroless gold plating solution according to claim 12, wherein the water-soluble amine is ethylenediamine.

14. The electroless gold plating solution according to claim 12, wherein the phenyl compound based reducing agent is hydroquinone.

15. The electroless gold plating solution according to claim 14, wherein the water-soluble amine is ethylenediamine.

16. A method for electroless plating, comprising immersing a material to be plated into a gold plating solution which comprises a gold salt, a phenyl compound based reducing agent, and a water-soluble amine selected from the group consisting of ethylenediamine, diethylenetriamine, triethylenetetramine, tetraethylenepentamine and pentaethylenehexamine.

17. The method according to claim 16, the phenyl compound based reducing agent is hydroquinone, methylhydroquinone, or p-phenylenediamine.

18. The method according to claim 17, wherein said phenyl compound based reducing agent is hydroquinone or methylhydroquinone.

19. The method according to claim 18, wherein said water-soluble amine is ethylenediamine.

20. The method according to claim 16, wherein said gold plating solution further comprises an impurity metal-shielding agent as an additive.

* * * * *